US008430559B2

(12) United States Patent
Musy et al.

(10) Patent No.: US 8,430,559 B2
(45) Date of Patent: Apr. 30, 2013

(54) DRIVING MEMBER FOR A TIMEPIECE MOVEMENT

(75) Inventors: Jean-Pierre Musy, Begnins (CH); Frederic Maier, Neuchatel (CH)

(73) Assignee: Patek Philippe SA Geneve, Geneva (CH)

( * ) Notice: Subject to any disclaimer, the term of this patent is extended or adjusted under 35 U.S.C. 154(b) by 174 days.

(21) Appl. No.: 13/129,912

(22) PCT Filed: Sep. 25, 2009

(86) PCT No.: PCT/IB2009/006951

§ 371 (c)(1),
(2), (4) Date: May 18, 2011

(87) PCT Pub. No.: WO2010/061251

PCT Pub. Date: Jun. 3, 2010

(65) Prior Publication Data

US 2011/0222376 A1 Sep. 15, 2011

(30) Foreign Application Priority Data

Nov. 28, 2008 (CH) ..... 1863/08

(51) Int. Cl.
*G04B 1/10* (2006.01)

(52) U.S. Cl.
USPC ..... 368/140; 368/203

(58) Field of Classification Search ..... 368/203, 368/140–144
See application file for complete search history.

(56) References Cited

U.S. PATENT DOCUMENTS

| | | | | |
|---|---|---|---|---|
| 249,845 | A * | 11/1881 | Lewis | 368/243 |
| 410,327 | A * | 9/1889 | Meylan | 368/142 |
| 4,363,553 | A * | 12/1982 | Thomi et al. | 368/140 |
| 7,452,123 | B2 * | 11/2008 | Girardin et al. | 368/140 |
| 2010/0002548 | A1 * | 1/2010 | Hessler et al. | 368/129 |
| 2010/0246339 | A1 * | 9/2010 | Mertenat | 368/142 |

FOREIGN PATENT DOCUMENTS

| | | |
|---|---|---|
| CH | 151391 | 12/1931 |
| CH | 599580 | 5/1977 |
| CH | 693516 | 9/2003 |
| EP | 1115040 | 7/2001 |
| FR | 1131320 | 2/1957 |
| FR | 1195976 | 11/1959 |
| FR | 1152235 | 1/1960 |

OTHER PUBLICATIONS

International Search Report in PCT/IB2009/006951, Jan. 22, 2010.

* cited by examiner

*Primary Examiner* — Sean Kayes
(74) *Attorney, Agent, or Firm* — Bacon & Thomas, PLLC

(57) ABSTRACT

A driving member for a timepiece movement includes a shaft, and a drum and a rotating member both mounted on the shaft. The drum and the rotating member are able to rotate with respect to each other and include teeth on their periphery. First and second superposed spiral springs have outer ends fixed to the drum and to the rotating member respectively and inner ends connected to each other to connect the springs in series. The drum and the rotating member fit together at least in the area of the peripheral wall of the drum so as to together form a closed housing containing the springs.

10 Claims, 3 Drawing Sheets

DRIVING MEMBER FOR A TIMEPIECE MOVEMENT

BACKGROUND OF THE INVENTION

1. Field of the Invention

The present invention relates to a driving member for a timepiece movement.

2. Related Art

In a mechanical timepiece movement, the driving member is the member which provides the energy to the rest of the movement to turn the gear train. The driving member is generally in the form of a barrel having a barrel drum, a spiral driving spring, or "barrel spring", housed in the barrel drum, a barrel arbor and a barrel cover. The barrel drum pivots around the barrel arbor and has a toothing on its periphery which co-operates with the gear train to drive it. The inner end of the driving spring is fixed to the barrel arbor to which a ratchet-wheel is fixedly attached, which ratchet-wheel is driven by the winding stem of the watch (in the case of a manual winding watch) or by its oscillating weight (in the case of an automatic winding watch). The outer end of the driving spring is fixed to the inner peripheral surface of the barrel drum via a brace which can be fixed or sliding. Rotation of the ratchet-wheel by the winding stem or the oscillating weight rotates the barrel arbor which tightens the driving spring and thus enables the latter to accumulate energy. The driving spring then progressively releases this energy as it relaxes, rotating the barrel drum.

An important feature of a mechanical timepiece movement is its duration of run, i.e., the duration during which it can operate between two windings. In order to increase the duration of run, it is known to arrange several barrels in series in a single movement. Examples of such an arrangement can be seen in the following patents or patent applications: EP 1 115 040, CH 693 516, FR 1 195 976 and CH 599 580. The arrangements described in these documents all have the disadvantage of being bulky and complicated. They indeed require parts such as the centre piece 6' and barrel covers 9 and 12 in document EP 1 115 040, the hub 35 and the intermediate barrel bridge 14 in document CH 693 516, the disk 9 and the hubs 5 in document FR 1 195 976 and the toothings 1 to 4 in document CH 599 580.

BRIEF SUMMARY OF THE INVENTION

An object of the present invention is to propose a driving member for a timepiece movement which comprises superposed driving springs mounted in series and which can be relatively simple and take up little space.

To this end there is provided a driving member for a timepiece movement comprising a shaft, a drum and a rotating member both mounted on the shaft, said drum and said rotating member being able to rotate with respect to each other and each comprising a toothing on their periphery, and first and second superposed spiral springs, the outer ends of which are fixed to the drum and to the rotating member respectively and the inner ends of which are connected to each other to connect the springs in series, characterised in that the drum and the rotating member fit together at least in the area of the peripheral wall of the drum so as to together form a closed housing containing the springs.

Therefore, in the invention, the function of covering the drum is ensured by the rotating member, i.e., by a member playing an active role, for example that of a ratchet-wheel, in the operation of the driving member. This dual function of the rotating member allows the number of parts forming the driving member to be reduced. It also allows the space normally taken up by the barrel covers to be saved and thus the vertical bulk of the driving member to be reduced.

Preferably, the shaft can rotate, the drum and the rotating member can rotate with respect to the shaft, and the respective inner ends of the springs are fixed to the shaft. The driving member is therefore simple and the available space for the springs in the housing is increased whilst allowing the shaft to retain a diameter which is sufficient to achieve good mechanical strength.

In a first embodiment of the invention, the rotating member is a wheel. At least a part of the surface of the wheel facing the base of the drum can be located fully within the drum and take up, with the shaft, substantially all of the inner diameter of the drum. The outer end of the second spring can be fixed to the wheel using a brace of which one end is fixed to the outer surface of the last turn of the second spring and the other end is free, and using a protruding portion of the wheel squeezed between the brace and said outer surface.

In a second embodiment of the invention, the rotating member is another drum. The respective peripheral walls of the drums can have complementary steps allowing the drums to fit together.

The present invention further proposes a timepiece movement comprising a driving member as defined above.

Typically, the ends of the shaft are guided in rotation in bearings respectively provided in supports (bottom plate and bridge) of the movement.

In one advantageous variation, the movement comprises first and second supports (bottom plate and bridge) which receive the ends of the shaft, the shaft comprises a first annular face against which the drum can rest, a surface of the first support facing the drum or a surface of the drum facing the first support comprises a second annular face whose inner diameter is greater than the outer diameter of the first annular face, the shaft comprises a third annular face against which the rotating member can rest, and a surface of the second support facing the rotating member or a surface of the rotating member facing the second support comprises a fourth annular face whose inner diameter is greater than the outer diameter of the third annular face.

DESCRIPTION OF THE DRAWINGS

Other features and advantages of the present invention will become clear upon reading the following detailed description with reference to the accompanying schematic drawings, in which.

DETAILED DESCRIPTION OF PREFERRED EMBODIMENTS OF THE INVENTION

Figure 1:
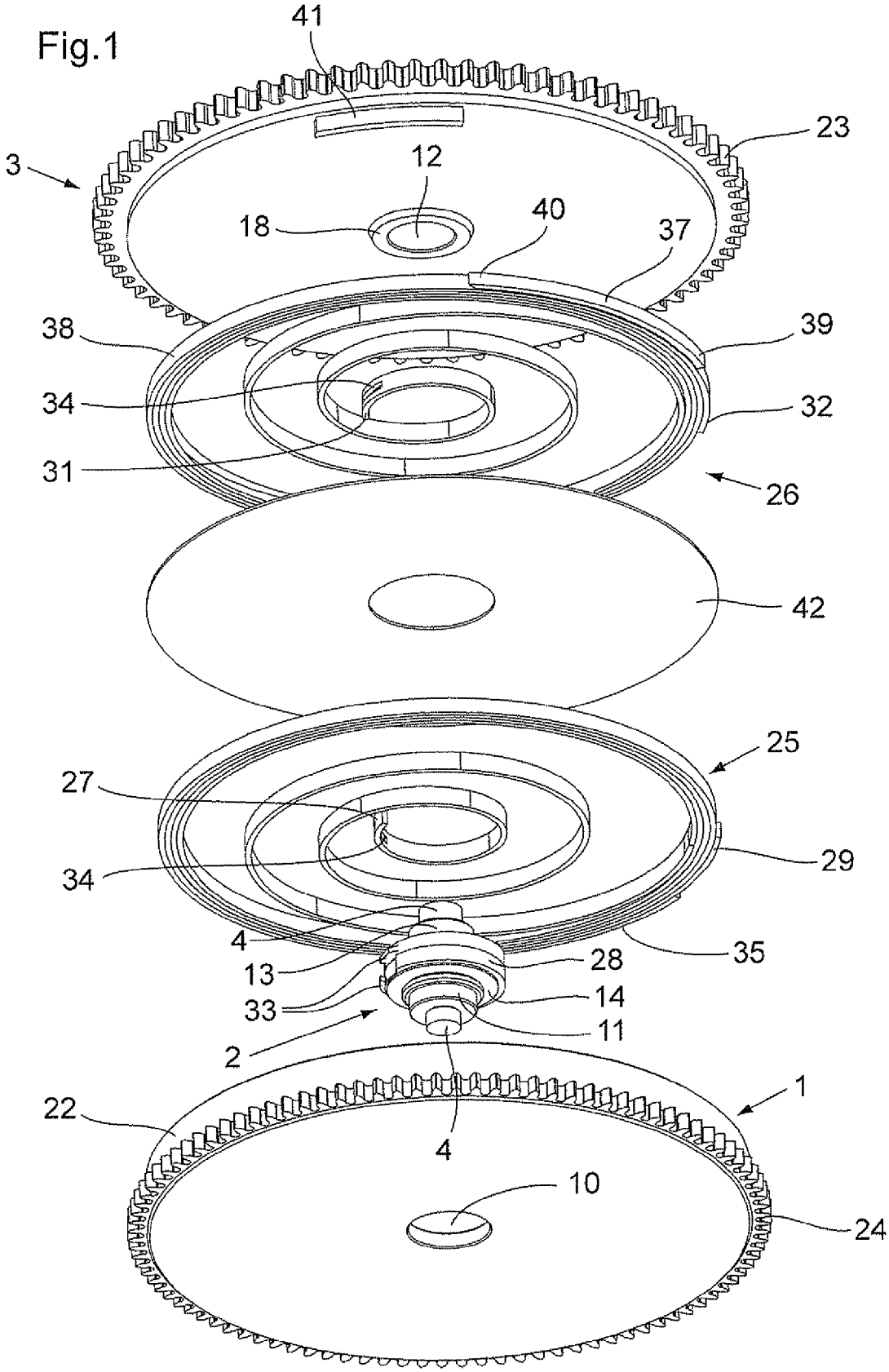
FIGS. 1 and 2 are exploded perspective views, from two different viewpoints, of a driving member in accordance with a first embodiment of the invention.
Figure 2:
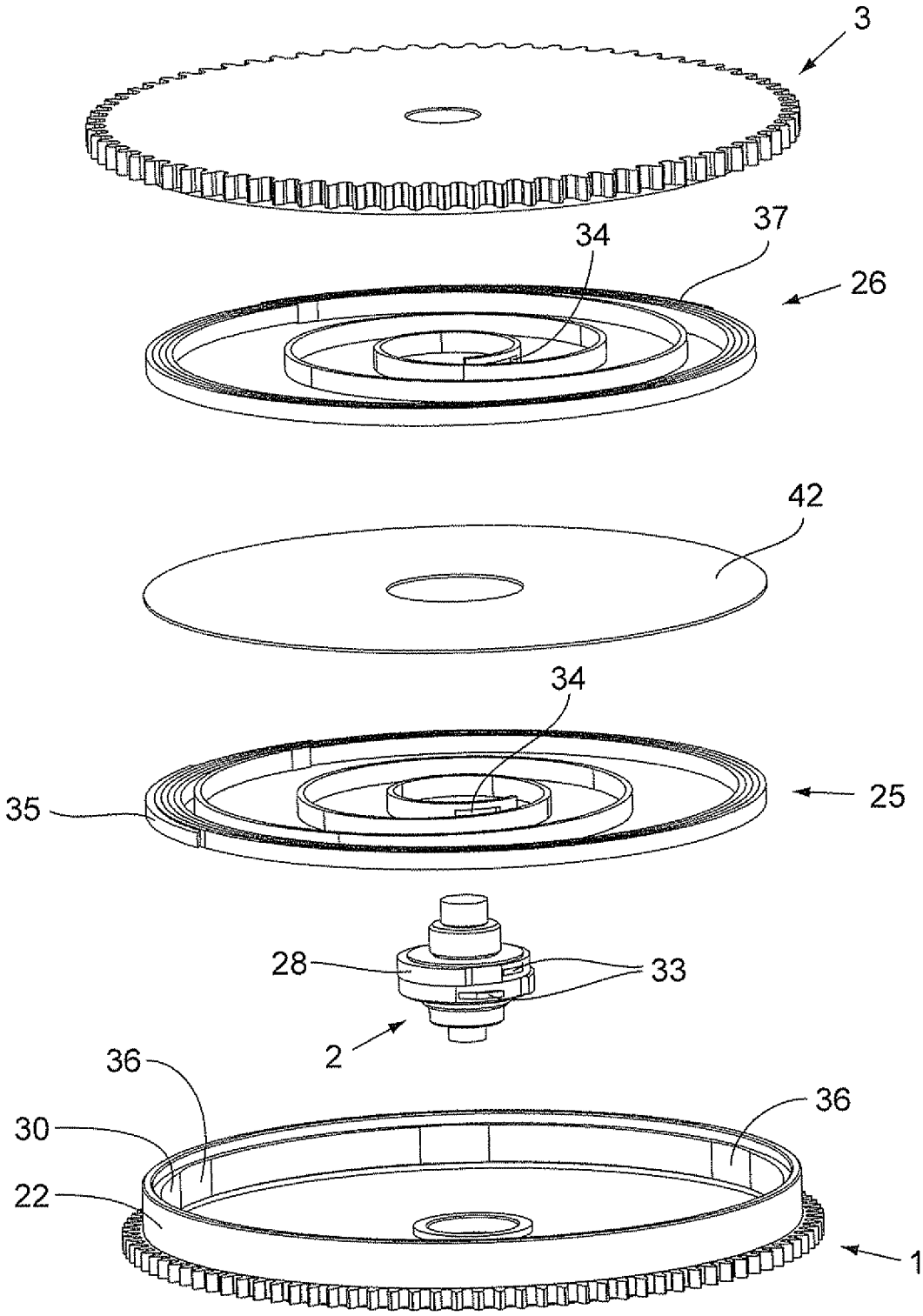
Figure 3:
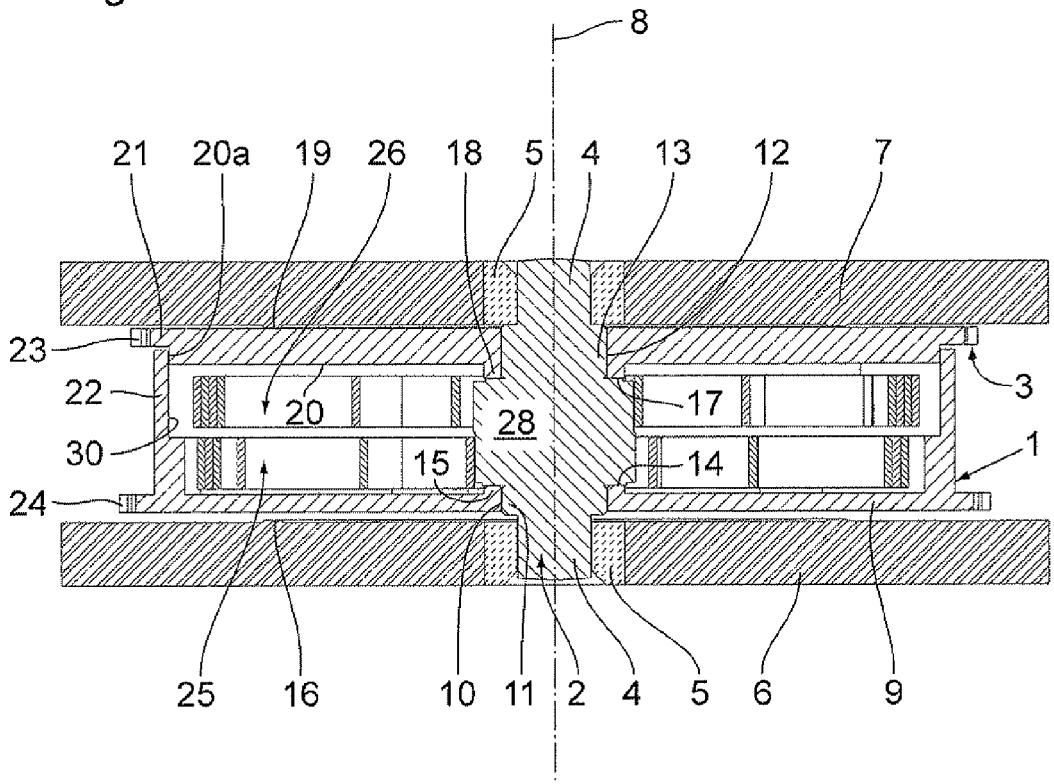
FIG. 3 is an axial cross-sectional view of the driving member in accordance with the first embodiment of the invention.

With reference to FIGS. 1 to 3, a driving member for a timepiece movement in accordance with a first embodiment of the invention is in the form of a barrel comprising a drum 1, an arbor 2 and a toothed wheel 3. The two ends or pivots 4 of the arbor 2 are guided in bearings or stones 5 respectively provided in the bottom plate 6 and the barrel bridge 7 of the movement to allow the arbor 2 to rotate about its imaginary axis 8 with respect to the bottom plate 6 and to the barrel bridge 7 which are both fixed. The drum 1 and the wheel 3 are mounted on the arbor 2 and can rotate with respect thereto about the imaginary axis 8. To this end, the base 9 of the drum 1 has a central hole 10, the wall of which surrounds and can slide on a cylindrical portion 11 of the arbor 2. In a comparable manner, the wheel 3 has a central hole 12, the wall of which surrounds and can slide on another cylindrical portion 13 of the arbor 2. An annular face 14 of the arbor 2 located in a plane perpendicular to the imaginary axis 8 is used to support a central annular edge 15 of the drum 1 defined by the inner surface of the base 9, i.e., its surface facing the wheel 3. An annular face 16 on the inner surface of the bottom plate 6, whose inner diameter is greater than the outer diameter of the face 14, is used to support the outer surface of the base 9 of the drum 1. Another annular face 17 of the arbor 2 located in a plane perpendicular to the axis 8 is used to support a central annular edge 18 of the wheel 3 defined by the inner surface of the wheel 3. An annular face 19 on the inner surface of the barrel bridge 7, whose inner diameter is greater than the outer diameter of the face 17, is used to support the outer surface of the wheel 3. These faces 14, 17, 16 and 19 allow the drum 1 and wheel 3 to be easily positioned on the arbor 2 in a stable manner. In one variation, the faces 16 and 19 could be provided on the outer surface of the base 9 of the drum 1 and on the outer surface of the wheel 3 respectively.

The drum 1 and the wheel 3 fit together (overlap), at least in the area of the peripheral wall 22 of the drum 1, to together form a closed housing. In other words, the wheel 3 is used as a cover closing the drum 1. In the illustrated example, the inner surface of the wheel 3 has a main annular portion 20 located within the drum 1 and taking up, together with the cylindrical portion 13 of the arbor 2, all or almost all of the inner diameter of the drum 1. A thinner peripheral portion 21 of the wheel 3 is completely outside the drum 1 and extends radially beyond the peripheral wall 22 of the drum. This peripheral portion 21 bears the toothing 23 of the wheel 3. A cylindrical surface 20*a* of the wheel 3 facing the cylindrical inner surface 30 of the peripheral wall 22 of the drum 1 is located at the transition between the main surface portion 20 and the peripheral portion 21. This surface 20*a* can contact the surface 30 or be slightly set apart from the surface 30 so as to avoid friction between the drum 1 and the wheel 3. The overlap of the surfaces 20*a* and 30 forms a chicane which in any case makes it difficult for undesirable elements (dirt, etc.) to enter the drum 1 or for any lubricant used in the drum 1 to leak. In one variation, a surface of the wheel 3, similar to surface 20*a*, could be located on the other side of the wall 22, i.e., facing the outer surface of the wall 22. This surface of the wheel 3 could be provided as an alternative to surface 20*a* or in addition to this surface 20*a*.

Like a traditional barrel drum, the drum 1 has a toothing 24 on its periphery, more precisely on the periphery of the base 9. This toothing 24 is intended to co-operate with the gear train of the movement to drive it. In addition to its function as a cover, the wheel 3 has the function of a ratchet, i.e., it is subjected to the action of a pawl or similar member (not shown) which forces it to rotate in a single direction. The wheel 3 engages the crown wheel of the movement driven by the winding stem or (indirectly) engages the pinion of an oscillating weight. However, in contrast to a traditional ratchet-wheel, the wheel 3 is not rotationally fixed to the arbor 2 as has been explained above.

The housing formed by the drum 1 and the wheel 3 contains first and second driving springs 25, 26 superposed in the direction of the axis 8 and each being formed of a spirally wound spring leaf. The spring 25 closest to the base 9 of the drum 1 has its inner end 27 which is fixed to a larger diameter central portion 28 of the arbor 2, called the "core", and its outer end 29 which is fixed to the inner surface 30 of the wall 22 of the drum 1. The spring 26 closest to the wheel 3 has its inner end 31 which is fixed to the core 28 and its outer end 32 which is fixed to the wheel 3. The term "fixed" is understood here to mean connections which make the inner ends 27, 31 rotationally fixed to the arbor 2 and the outer ends 29, 32 rotationally fixed to the drum 1 and to the wheel 3 respectively in the normal direction of rotation of the drum 1 and the wheel 3. As seen in FIGS. 1 and 2, the springs 25, 26 are wound in opposing directions.

The inner ends 27, 31 of the springs 25, 26 are fixed to the core 28 for example using respective lugs 33 which are provided on the core 28 and engage into holes 34 formed in the inner ends 27, 31. The outer end 29 of the spring 25 can be fixed to the inner surface 30 of the wall 22 of the drum 1 in a manner known per se using a fixed or sliding brace 35. In the illustrated example, the brace 35 is a sliding brace, i.e., it co-operates with one or more notches 36 (FIG. 2) formed in the surface 30 and can pass from one notch 36 to another to temporarily detach the outer end 29 from the drum 1 and thus slightly relax the spring 25 when the tension thereof exceeds a predetermined threshold so as to avoid excessive tensioning of the spring 25.

The outer end 32 of the spring 26 is fixed to the wheel 3 for example using a brace 37 provided on the outer surface 38 of the last turn of the spring 26. The downstream end 39 of the brace 37, proximate the outer end 32 of the spring 26, is fixed to said outer surface 38 whilst the upstream end 40 of the brace 37 is free to be able to be moved apart from the outer surface 38 by resilient deformation of the brace 37. The wheel 3 comprises on its inner surface a circular arc wall 41 which is coaxial with the central hole 12 and with the toothing 23. This wall 41 comes to be placed between the brace 37 and the outer surface 38 of the last turn of the spring 26 from the end 40 of the brace 37 and is held there by the resilient clamping effected by the brace 37, thereby fixing the outer end 32 of the spring 26 to the wheel 3. The outer surface 38 of the last turn of the spring 26 and the brace 37 face the inner surface 30 of the drum 1 but are not fixed thereto.

The springs 25, 26 are thereby connected in series. Rotation of the wheel 3 in its only direction of rotation, corresponding to the direction from the upstream end 40 to the downstream end 39 of the brace 37, drives the outer end 32 of the spring 26 in the same rotation and winds the two springs 25, 26 connected to each other by the arbor 2. The two springs 25, 26 ensure that the driving member in accordance with the invention can accumulate more energy than a traditional barrel having only a single spring of the size of each of the springs 25, 26 and thus provides the movement with an increased duration of run. The driving member in accordance with the invention is less bulky than the superposed barrel arrangements since the springs 25, 26 are located in a single drum 1. Since the inner ends 27, 31 of the springs 25, 26 are fixed to the arbor 2 itself, and not to a part which can move around the arbor 2 such as a centre piece or hub, the arbor 2 can have a diameter of a sufficient size so as to have sufficient mechanical strength without increasing the radial bulk of the driving member. Moreover, friction is thereby reduced. It will finally be noted that the bulk is further reduced by virtue of the fact that a single part, the wheel 3, has the dual function of a ratchet-wheel and a cover.

A washer 42 can be placed between the springs 25, 26, as shown in FIGS. 1 and 2 in order to separate them and thereby ensure that their turns do not become entangled with each other. This washer, which is not imperative in practice, does not need to be fixed in the drum 1; it can be floating. It can also be thinner than the barrel covers used in the Prior Art.

In one variation, the function of the ratchet-wheel could be performed by the drum 1 rather than by the wheel 3. In this case, it is the drum 1 which would be driven by the crown wheel or oscillating weight and would be subjected to the action of a pawl, whilst the wheel 3 would drive the gear train and would also be used as the cover on the drum 1. The positions of the drum 1 and of the wheel 3 could also be reversed, i.e., the drum 1 could be mounted on the side of the bridge 7 and the wheel 3 could be mounted on the side of the bottom plate 6.

Although it is advantageous that the inner ends of the springs 25, 26 are fixed to the arbor 2, it is possible to envisage a configuration inspired by that described in EP 1 115 040, wherein a connecting element surrounding the arbor 2 and freely rotatable with respect to the arbor 2, to the drum 1 and to the wheel 3, would connect the inner ends 27, 31 of the springs 25, 26. In this case, the rotating shaft or arbor 2 could be fixedly attached to the drum 1 or to the wheel 3 or could be replaced by a shaft which is fixed with respect to the bottom plate 6 and to the bridge 7.

Figure 4:
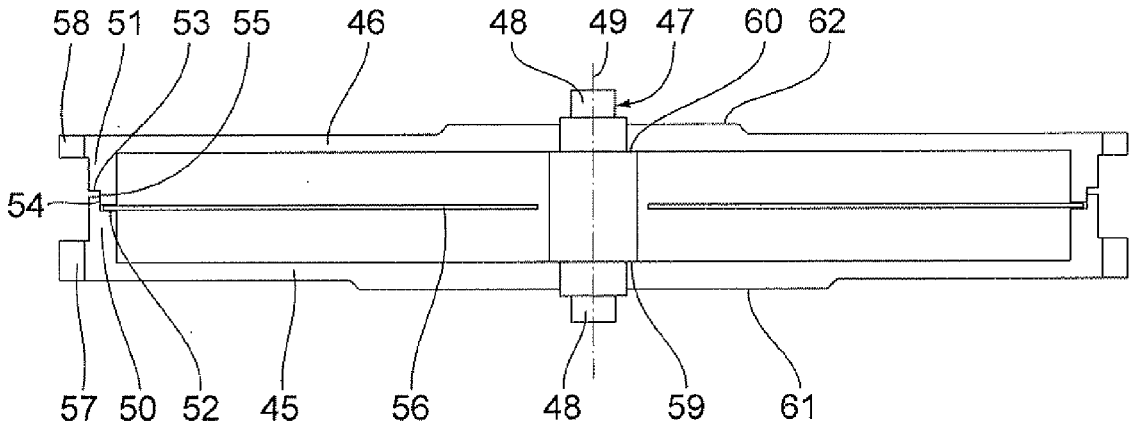
FIG. 4 is an axial cross-sectional view of a driving member in accordance with a second embodiment of the invention.

FIG. 4 shows a driving member for a timepiece movement in accordance with a second embodiment of the invention. The driving member in accordance with this second embodiment comprises two drums 45, 46 mounted on an arbor 47 so as to be able to rotate with respect to this arbor 47 and with respect to each other. The pivots 48 of the arbor 47 are guided in respective bearings provided in the bottom plate and a bridge of the movement to allow the arbor 47 to freely rotate about its imaginary axis 49 with respect to the bottom plate and to the bridge which are both fixed. The drums 45, 46 are mounted in an opposing manner in the direction of the imaginary axis 49 such that their respective inner spaces face each other and communicate with each other. The drums 45, 46 also fit together at their peripheral walls 50, 51. More precisely, each wall 50, 51 defines over its entire circumference a step 52, 53 complementary to the step 53, 52 of the other wall 51, 50, allowing the walls 50, 51 to overlap in the direction of the imaginary axis 49. The surfaces 54, 55 of the walls 50, 51 radially facing each other can contact each other or be slightly set apart so as to avoid friction between the drums 45, 46 when they rotate, in any case the chicane defined by the steps 52, 53 making it difficult for undesirable elements (dirt, etc.) to enter within the drums 45, 46 or for any lubricant used in the drums 45, 46 to leak.

The drums 45, 46 thereby form a closed housing. The interior of this housing contains first and second driving springs (not shown) superposed in the direction of the imaginary axis 49 and each formed by a spirally wound spring leaf. One of the springs is located in the drum 45 and the other spring is located in the drum 46. The outer end of each spring is fixed in a traditional manner, for example using a brace, to the inner surface of the wall 50 of the drum 45 and of the wall 51 of the drum 46 respectively. The inner end of each spring is fixed to the arbor 47 in a similar manner to the first embodiment so as to connect the springs in series. The brace connecting one of the springs to the corresponding drum 45 or 46 can be sliding so as to avoid excessive tensioning of the springs if the driving member has been wound excessively. The two springs can be separated by a washer 56.

The drums 45, 46 each comprise a toothing 57, 58 on their periphery. One of the drums 45, 46 engages the gear train of the movement to drive it. The other drum has the function of a ratchet-wheel. The driving member in accordance with this second embodiment functions in the same manner as in the first embodiment.

The drum 45 is disposed between an annular face 59 of the arbor 47 and the bottom plate of the movement. The drum 46 is disposed between another annular face 60 of the arbor 47 and said bridge of the movement. Faces 61, 62 provided on the outer surface of the base of the drums 45, 46 can rest against the bottom plate and the bridge respectively. In the example illustrated in FIG. 4, these faces 61, 62 extend radially from the central hole of the base of the drums 45, 46 which receives the arbor 47. As a variation, the faces 61, 62 could be of the same type as in the first embodiment so as to concentrate the friction in a well defined area.

It is possible to envisage configurations for mounting the drums 45, 46 other than that illustrated in FIG. 4, for example a configuration in which the arbor 47 would be replaced by a fixed shaft and in which a connecting element which can freely rotate about this shaft would connect the inner ends of the springs.

The driving member in accordance with this second embodiment has the same advantages as that in accordance with the first embodiment in terms of simplicity and bulk. It also has the advantage over the first embodiment of obviating the risks of friction between the spring 26 and the wall 22 of the drum 1.

The invention claimed is:

1. Driving member for a timepiece movement comprising a shaft, a drum and a rotating member both mounted on the shaft, said drum and said rotating member being able to rotate with respect to each other and each comprising teeth on a periphery thereof; first and second superposed spiral springs having outer ends which are fixed to the drum and to the rotating member, respectively, and inner ends which are connected to each other to connect the springs in series; said drum and rotating member fitting together at least in the area of a peripheral wall of the drum so as to together form a closed housing containing the springs.

2. Driving member as claimed in claim 1, wherein the shaft is rotatable; the drum and the rotating member are rotatable with respect to the shaft, and wherein the respective inner ends of the springs are fixed to the shaft.

3. Driving member as claimed in claim 1, wherein the rotating member is a wheel.

4. Driving member as claimed in claim 3, wherein the drum has an inner diameter, and wherein at least a part of the surface of the wheel facing the base of the drum is located fully within the drum and takes up, with the shaft, substantially all of the inner diameter of the drum.

5. Driving member as claimed in claim 3, wherein the outer end of the second spring is fixed to the wheel using a brace one end of which is fixed to the outer surface of a last turn of the second spring and a second end of which is free; and wherein a protruding portion of the wheel is squeezed between the brace and said outer surface.

6. Driving member as claimed in claim 1, wherein the rotating member comprises another drum.

7. Driving member as claimed in claim 6, wherein the respective peripheral walls of the drums have complementary steps enabling the drums to frit together.

8. Timepiece movement comprising a driving member as claimed in claim 1.

9. Timepiece movement as claimed in claim 8, including shaft ends, said shaft ends being guided in rotation in bearings respectively provided in supports of the movement.

10. Timepiece movement as claimed in claim 8, including shaft ends, said movement comprising first and second supports which receive the shaft ends, said shaft comprising a first annular face against which the drum rests; a surface of the first support facing the drum or a surface of the drum facing the first support comprising a second annular face whose inner diameter is greater than the outer diameter of the first annular face; the shaft including a third annular face against which the rotating member rests; and a surface of the second support facing the rotating member or a surface of the rotating member facing the second support comprising a fourth annular face whose inner diameter is greater than the outer diameter of the third annular face.

* * * * *